US008960952B2

(12) United States Patent
Gianordoli

(10) Patent No.: US 8,960,952 B2
(45) Date of Patent: Feb. 24, 2015

(54) LED MODULE FOR SPOTLIGHTS

(75) Inventor: Stefan Gianordoli, Fürstenfeld (AT)

(73) Assignee: Tridonic Jennersdorf GmbH (AT)

( * ) Notice: Subject to any disclaimer, the term of this patent is extended or adjusted under 35 U.S.C. 154(b) by 152 days.

(21) Appl. No.: 13/510,835

(22) PCT Filed: Apr. 8, 2011

(86) PCT No.: PCT/EP2011/055468
§ 371 (c)(1),
(2), (4) Date: Jul. 27, 2012

(87) PCT Pub. No.: WO2011/124666
PCT Pub. Date: Oct. 13, 2011

(65) Prior Publication Data

US 2013/0016505 A1 Jan. 17, 2013

(30) Foreign Application Priority Data

Apr. 9, 2010 (DE) ..... 20 2010 004 857 U
May 20, 2010 (DE) ..... 20 2010 007 032 U

(51) Int. Cl.

| | |
|---|---|
| ***F21V 9/00*** | (2006.01) |
| ***F21V 13/08*** | (2006.01) |
| ***F21S 2/00*** | (2006.01) |
| ***F21S 8/02*** | (2006.01) |
| ***F21V 15/01*** | (2006.01) |
| *F21Y 101/02* | (2006.01) |
| *F21Y 105/00* | (2006.01) |

(52) U.S. Cl.
CPC .. *F21S 2/005* (2013.01); *F21S 8/02* (2013.01); *F21V 15/01* (2013.01); *F21Y 2101/02* (2013.01); *F21Y 2105/001* (2013.01)
USPC ..... 362/231; 362/249.02

(58) Field of Classification Search
CPC ..... F21V 9/00; F21V 13/08
USPC ..... 362/147, 231, 247, 249.02
See application file for complete search history.

(56) References Cited

U.S. PATENT DOCUMENTS

| | | | | |
|---|---|---|---|---|
| 5,838,247 | A * | 11/1998 | Bladowski | 362/241 |
| 2003/0156416 | A1 | 8/2003 | Stopa et al. | |
| 2005/0174780 | A1 * | 8/2005 | Park | 362/294 |
| 2009/0103296 | A1 | 4/2009 | Harbers et al. | |
| 2009/0140285 | A1 | 6/2009 | Lin et al. | |
| 2009/0161356 | A1 * | 6/2009 | Negley et al. | 362/231 |
| 2009/0283779 | A1 | 11/2009 | Negley et al. | |
| 2009/0323304 | A1 | 12/2009 | Helbing | |
| 2010/0259919 | A1 * | 10/2010 | Khazi et al. | 362/84 |

FOREIGN PATENT DOCUMENTS

| | | | |
|---|---|---|---|
| DE | 102006018297 | A1 | 10/2007 |
| EP | 2056014 | A2 | 5/2009 |
| GB | 2463057 | A | 3/2010 |
| WO | 2009025284 | A1 | 2/2009 |

OTHER PUBLICATIONS

English translation of the International Preliminary Report on Patentability issued in connection with the corresponding International Application No. PCT/EP2011/055468 on Oct. 18, 2012.
International Search Report issued in connection with the corresponding International Application No. PCT/EP2011/055468 on Oct. 20, 2011.

* cited by examiner

*Primary Examiner* — David V Bruce
(74) *Attorney, Agent, or Firm* — The H.T. Than Law Group

(57) ABSTRACT

Set of a plurality of LED emitters, wherein the LED emitters in the set generate a different luminous efficacy, and have a standard housing.

21 Claims, 3 Drawing Sheets

LED MODULE FOR SPOTLIGHTS

BACKGROUND OF THE INVENTION

The present invention relates generally to lighting which uses LEDs as light-generating elements.

SUMMARY OF THE INVENTION

In this case, the object of the present invention is to specify particularly advantageous configurations. An advantageous configuration is in this case firstly to be understood to mean that a large number of identical parts can also be used for LED emitters with different luminous efficacy (lumens) on the production side. Alternatively or in addition, an advantageous configuration can also be understood to mean that the luminous efficacy emitted by the LED emitter is conducted very efficiently from the emitter.

This object is achieved by the features of the independent claims. The dependent claims advantageously develop the central concept of the invention.

The invention provides a set of a plurality of LED emitters, wherein the LED emitters in the set generate a different luminous efficacy, the LED emitters have a standard housing.

Each emitter can have an LED module with a plurality of LED chips, wherein the mid-distance between the LED chips of an LED module and also the mid-distance between LED chips of LED modules of different emitters is preferably constant. In this case, the mid-distance is the distance between the axes of symmetry of two mirror-symmetrical or rotationally symmetrical LED chips.

The mid-distance can be between 1.5 mm and 4 mm, preferably 2.5 to 4 mm.

The mid-distance between the LED chips which has been selected so as to be relatively small is used for improved luminous efficacy. By virtue of said small mid-distance between the LED chips on the LED module, homogenous white light is emitted by the LED modules or LED emitters, while the heat dissipation of the LED module remains optimized. The use of metal-core printed circuit boards as mounts for the LED module is in this case particularly advantageous.

The LED chips can be covered with a dispensed casting compound, such as a so-called dome-shaped globe top or another cover, for example, wherein the globe tops of adjacent LED chips preferably do not run with one another.

Globe tops which run with one another are also conceivable. In this exemplary embodiment, a plurality of LEDs are positioned beneath a common globe top.

Furthermore, the invention relates to an LED emitter, having:

a plurality of LED chips spaced uniformly apart from one another on a common mount, wherein the LED chips are covered by a casting compound, and the LED chips form a light field, a reflector, which is positioned directly on the mount, extends away from the mount and surrounds the light field narrowly on its side positioned on the mount The light area can make up at least 30%, preferably at least 50%, even more preferably 55%, of the cross-sectional area of that side of the reflector which is positioned on the mount.

The lateral surface of the reflector can have a parabolic or a linear profile.

The surface of the reflector can be faceted and/or patterned.

The total area of the covered LED chips can make up at least 20%, preferably at least 25%, even more preferably at least 35%, of that side of the reflector which is positioned on the mount.

The LED emitter can be in the form of a so-called ceiling-mounted emitter for installation in suspended ceilings.

The LED emitter can have a housing with a light exit opening, which is covered by a diffuser (and/or phosphor disk) or is open.

BRIEF DESCRIPTION OF THE DRAWINGS

Further advantages, features and properties of the invention will now be explained in more detail with reference to the description of an exemplary embodiment and the figures of the attached drawings.

DETAILED DESCRIPTION OF THE INVENTION

The invention relates in particular to a group of identical LED emitters, wherein the group has LED emitters with different luminous efficacy (lumens). Emitters with at least two different luminous efficacies in this case have a different number of LED chips, but mounts (printed circuit boards) with identical dimensions, which ensures an increase in the number of identical parts even for LED emitters with different luminous efficacies.

Figure 1:
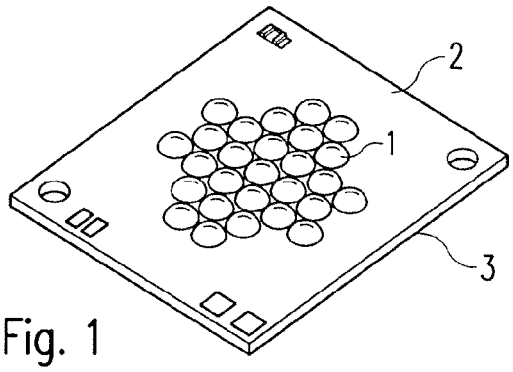
FIGS. 1, 2 and 3 show LED modules for LED emitters of different luminous efficacy.

In this case, FIG. 1 shows an LED module, i.e. a large number of LED chips 1 on a printed circuit board mount 2. This LED module 3 in FIG. 1 can be provided for a luminous efficacy of 2000 lumens, for example.

Figure 2:
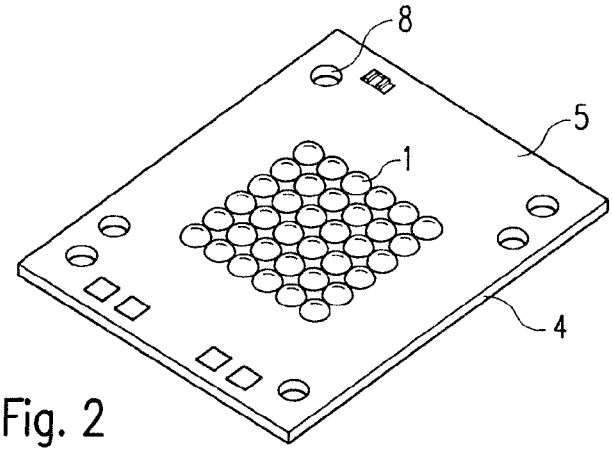

FIG. 2 now shows a further LED module, which can be dimensioned, for example, for a luminous efficacy (when installed in an LED emitter) of 3000 lumens and correspondingly has more LED chips.

Figure 3:
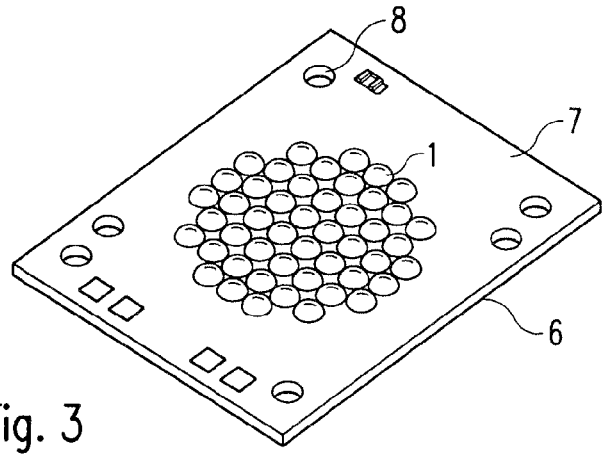

This LED module 4 has the same printed circuit board 5 as the LED module 6 illustrated in FIG. 3 for a luminous efficacy of 4000 lumens, for example, which LED module 6 therefore has an identical printed circuit board as regards dimensions and fitting holes 8.

Further standardization can be provided in that the distance between the light spots, i.e. the mid-points of the LED chips 1, is identical for all of the LED modules 3, 5, 6 in FIGS. 1, 2 and 3. The distance between the mid-points is in this case the distance between the axes of symmetry of two mirror-symmetrical or rotationally symmetrical LED chips.

The distance between the light spots (mid-point distance) can be, for example, between 2 and 4 mm, preferably between 3.2 and 3.8 mm. As has been mentioned, this distance between the light spots can be selected to be identical for the LED modules of different powers, which in turn can result in standardization possibilities (use of identical parts) as regards the downstream optics (reflector, diffuser, phosphor disk), which will be explained below with reference to FIG. 4.

Figure 4:
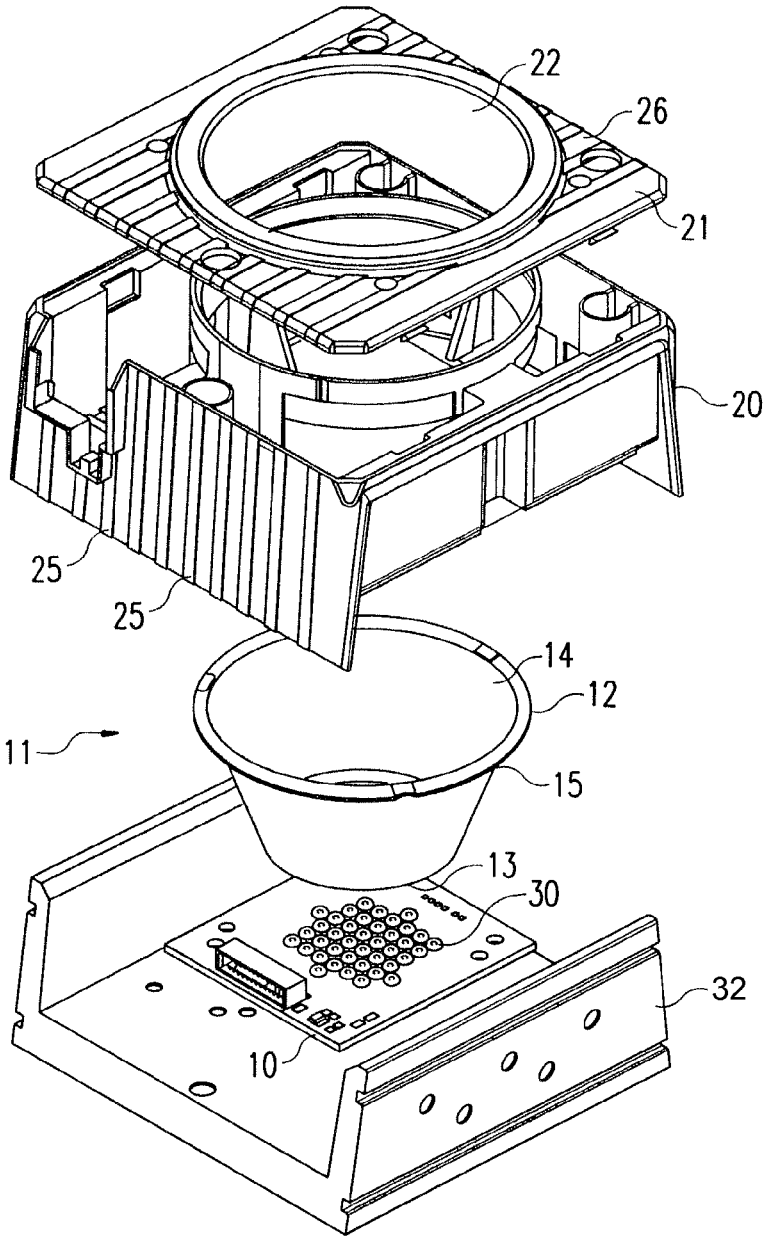
FIG. 4 shows an exploded view of an LED emitter with one of the LED modules shown in FIGS. 1 to 3.

As can be seen from FIG. 4, the LED module shown in FIGS. 1, 2 and 3, now denoted by the reference symbol 10, is installed in an LED emitter, which can be used as a downlight or spotlight, for example. This emitter, denoted overall by 11 in FIG. 4, has a bottom-side housing with a heat sink 32, for example, on which the LED module 10 is fitted in thermal contact.

Preferably, at least essential parts of the bottom housing part 32 are manufactured from a material with high thermal conductivity, in particular from metal.

Preferably, a reflector 12 is positioned in direct contact on the printed circuit board of the LED module 10, said reflector preferably being configured in such a way that that side 13 of the reflector which is open towards the LEDs has a smaller cross-sectional area than the exit side 14 of the reflector 12 which faces away from the LEDs. There is therefore a reflector which extends in the light emission direction.

The reflector is preferably rotationally symmetrical.

The contours (generatrices) of the reflector 12 can in this case be linear, with the result that a truncated cone shape is produced. Alternatively, however, other profiles are also conceivable, in particular bent profiles such as parabolic profiles, for example, for the contour of the lateral surface 15 of the reflector 12.

Finally, an upper part 20 and a covering disk 21 with a central, preferably circular opening 22 is positioned on the bottom part 12 of the housing.

Optionally, a diffuser (not shown) can be inserted into the circular exit opening 22, it being possible for said diffuser to optionally also perform further optical functions, in addition to the diffuser effect thereof. For example, a color conversion medium for changing the wavelength (for example in the form of a phosphor disk) can also be inserted into the diffuser, if used.

The phosphor disk can also be used without diffuse particles in the LED emitter. The use of phosphor disks and/or diffusers with patterned surfaces is also conceivable.

Overall, it is preferred, however, that a color conversion medium (for example inorganic or organic phosphors) 30 is applied in the form of a so-called globe top or in another way to the respective LED chip in direct contact therewith so as to generate white light.

As has been mentioned, the housing shown in FIG. 4 and the reflector are used in the form of identical parts for LED modules likewise with different dimensions and in any case different luminous efficacies (lumens).

The use of a phosphor disk in combination with a white reflector (which forms a highly reflective surface) is particularly preferred when the LED module 10 has LEDs of different spectrums, for example monochromatic LEDs, in particular red LEDs, in combination with a preferably phosphor-converted for example blue or UV LED (which emits white light, for example) or with a further monochromatic, for example blue or green LED. The phosphor-converted LEDs can emit green, white or red light, for example.

The reflector 12 having a highly reflective surface (for example white surface) ensures effective light mixing, with the result that the space delimited by the reflector 12 can also be referred to as a light mixing chamber within the LED emitter. Homogenous white light is generated from the monochromatic or from the monochromatic and phosphor-converted light-emitting diodes with the aid of the light mixing chamber.

An additional reflector (not shown), which can be positioned on the LED emitter 11, is also conceivable. A multi-stage optics system with targeted light direction can be realized by means of this additional reflector.

The reflector 12 can be manufactured from a coated polymer, a metal such as aluminum etc.

The reflector consisting of metal in conjunction with a diffuser is preferred for the exemplary embodiments in which phosphor-converted LEDs are primarily used. By using a metal reflector, the light direction can be controlled as desired without the use of a multi-stage optics system.

Conventional metal reflectors can be incorporated in the LED emitters. They provide further standardization possibilities.

Figure 5:
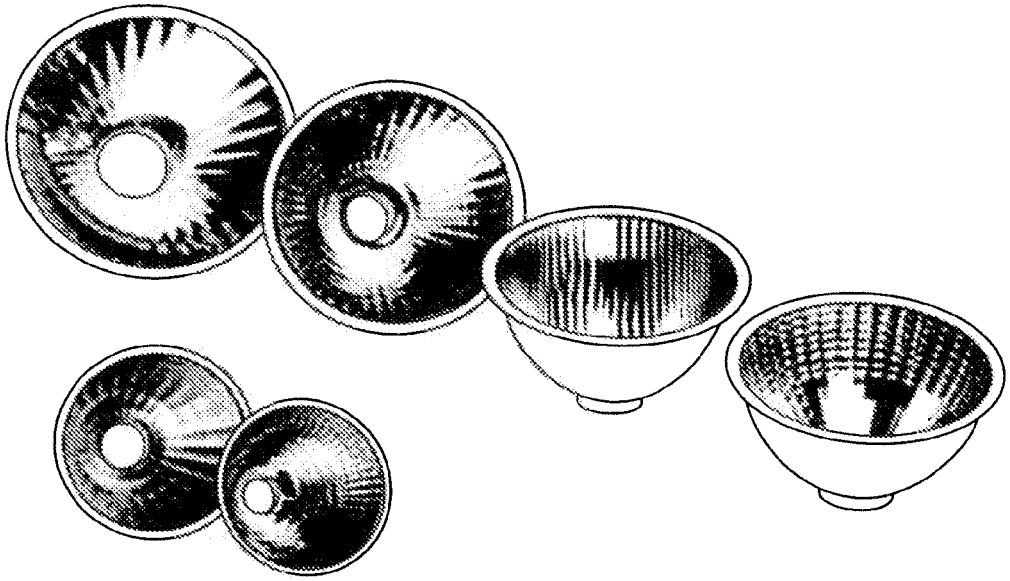
FIG. 5 shows a facet reflector which can be used in the context of the present invention.

The reflector can be faceted, as is shown in the example in FIG. 5.

The LED emitter 11 illustrated in FIG. 4 is used in particular as a replacement for existing emitters with conventional light-emitting means, which therefore use a halogen or xenon lamp as light-emitting means. This configuration is generally referred to as a "retrofit".

In accordance with a further embodiment, the diameter of the reflector 12 is matched to the outer contour of the light field formed by the LEDs on the module 10. In the case of a relatively small light field, such as in FIG. 1, for example, therefore, a smaller reflector can be selected than in the case of a relatively large light field as illustrated in FIGS. 2 and 3.

In this case, the invention is based on the principle that that opening side 13 of the reflector 12 which faces the LEDs surrounds the active light field (outer contour of the LEDs on the LED module 10) as narrowly as possible, which increases the efficiency (light output per electrical power, in watts) of the depicted LED emitter 11. Since the distance between the light spots is selected to be as small as possible, as mentioned already at the outset, the area of the entry side 13 of the extending reflector 12 can therefore also be kept as small as possible.

As can already be seen schematically in FIG. 4, the extending reflector 12 according to the invention is positioned directly on the printed circuit board of the LED module 10 and is not spaced apart therefrom, which further increases the luminous efficacy.

A further concept of the present invention consists in that the active light field is formed by discrete light spots (LED chips spaced apart from one another with separate coating in the form of globe tops), but the "fill level" of the light field, i.e. the total area of the globe tops in comparison to the area formed by the outer contour of the light field, is as high as possible.

Preferably, the fill level of the light field, i.e. the proportion of the area of the outer contour of the light field made up by the globe top area, is at least 15%, preferably 20%, even more preferably 35%.

A further important parameter according to the invention is the ratio of the area of the outer contour of the light field to the area of the entry side 13 of the reflector 12. According to the invention, the area of the outer contour of the light field is at least 30%, preferably 50%, even more preferably 55%, of the area of the entry side 13 of the extending reflector 12.

As can be seen schematically in FIG. 4, the outer side of the upper part 20 of the housing of the LED emitter 11, said upper part being manufactured from polymer (with a high thermal conductivity), for example, can be profiled so as to form cooling ribs 25.

These cooling ribs can extend beyond the cover part 21 as well (see reference symbol 26).

The invention claimed is:

1. A set of a plurality of LED emitters, wherein the LED emitters in the set generate a different luminous efficacy wherein each LED emitter comprises a LED module with a plurality of LED chips, and the LED emitters have a standard housing, wherein the housing is standardized for all LED emitters in the set in the form of identical parts, such that the standard housing is interchangeable for all LED emitters in the set.

2. The set as claimed in claim 1, wherein the mid-distance between the LED chips of an LED module and also the mid-distance between LED chips of LED modules of different emitters is constant.

3. The set as claimed in claim 2, wherein the mid-distance is between about 1.5 mm and about 4 mm.

4. The set as claimed in claim 2, wherein the LED chips are covered with a dispensed globe top or another cover, wherein the globe tops or covers of adjacent LED chips do not run with one another.

5. An LED emitter, having:

a plurality of LED chips spaced uniformly apart from one another on a common mount, wherein the LED chips are covered by a casting compound, and the LED chips form a light field, a reflector, which is positioned directly on the mount, extends away from the mount and surrounds the light field narrowly on its side positioned on the mount, wherein said side of the reflector positioned on the mount has a smaller cross-sectional area than an exit area of the reflector extending away from the mount, wherein the total area of the covered LED chips is smaller than the cross-sectional area of the side of the reflector positioned on the mount and makes up at least 20% of the cross-sectional area of side of the reflector which is positioned on the mount.

6. The LED emitter as claimed in claim 5, wherein the light area makes up at least 30%-of the cross-sectional area of the side of the reflector which is positioned on the mount.

7. The LED emitter as claimed in claim 5, wherein the lateral surface of the reflector has a parabolic or a linear profile.

8. The LED emitter as claimed in claim 5, wherein the reflector is manufactured from a polymer and/or from metal.

9. The LED emitter as claimed in claim 5, wherein the reflector is faceted.

10. The LED emitter as claimed in claim 5, wherein the emitter has a multi-stage optics system.

11. The LED emitter as claimed in claim 5, which is in the form of a so-called ceiling-mounted emitter for installation in suspended ceilings.

12. The LED emitter as claimed in claim 5, which has a housing with a light exit opening, which is covered by a diffuser and/or by a phosphor disk or is open.

13. The LED emitter as claimed in claim 5, wherein the LED emitter has monochromatic and/or phosphor-converted LED chips.

14. The LED emitter as claimed in claim 5, wherein the LED emitter has green, red and/or blue LED chips.

15. The LED emitter as claimed in claim 5, wherein the common mount is a metal-core printed circuit board.

16. The LED emitter as claimed in claim 5, wherein the mid-distance between the LED chips on the common mount is constant and is between about 2 mm and about 4 mm.

17. The LED emitter as claimed in claim 16, wherein the mid-distance between the LED chips is between about 3.2 mm and about 3.8 mm.

18. The set as claimed in claim 3, wherein the mid-distance is between about 2.5 mm and 4 mm.

19. The LED emitter as claimed in claim 5, wherein the total area of the covered LED chips makes up at least about 25% of the side of the reflector which is positioned on the mount.

20. The LED emitter as claimed in claim 6, wherein the light area makes up at least 50% of the cross-sectional area of the side of the reflector which is positioned on the mount.

21. A set of a plurality of LED emitters, wherein the LED emitters in the set generate a different luminous efficacy wherein each LED emitter comprises a plurality of LED chips disposed on a substantially planar substrate, and the LED emitters have a standard housing, wherein the housing is standardized for all LED emitters in the set in the form of identical parts.

* * * * *